US006360466B1

(12) United States Patent
Thomas, III

(10) Patent No.: US 6,360,466 B1
(45) Date of Patent: Mar. 26, 2002

(54) DATA STORAGE CARTRIDGE WITH MULTIPLE LABELS

(75) Inventor: Fred C. Thomas, III, Ogden, UT (US)

(73) Assignee: Iomega Corporation, Roy, UT (US)

( * ) Notice: Subject to any disclaimer, the term of this patent is extended or adjusted under 35 U.S.C. 154(b) by 0 days.

(21) Appl. No.: 09/574,911

(22) Filed: May 19, 2000

(51) Int. Cl.[7] ..... G09F 3/10
(52) U.S. Cl. ..... 40/638; 40/630
(58) Field of Search ..... 40/630, 638, 661.09; 283/81

(56) References Cited

U.S. PATENT DOCUMENTS

| | | | | |
|---|---|---|---|---|
| 3,691,140 A | | 9/1972 | Silver | 260/78.5 |
| 3,857,731 A | | 12/1974 | Merrill et al. | 117/122 |
| 4,166,152 A | | 8/1979 | Baker et al. | 428/522 |
| 4,495,318 A | | 1/1985 | Howard | 524/375 |
| 4,837,652 A | * | 6/1989 | Kerby | 360/133 |
| 5,045,569 A | | 9/1991 | Delgado | 521/60 |
| 5,378,300 A | * | 1/1995 | Huvard et al. | 156/344 |
| 5,649,380 A | * | 7/1997 | Zhang | 40/630 |
| 5,722,538 A | * | 3/1998 | Neely et al. | 206/308.1 |
| 5,806,222 A | * | 9/1998 | Shaffer | 40/638 |
| B14,166,152 A | | 5/1999 | Baker et al. | 428/522 |
| 6,040,006 A | | 2/2000 | Le Riche et al. | 427/209 |

* cited by examiner

*Primary Examiner*—Christopher P. Schwartz
(74) *Attorney, Agent, or Firm*—Woodcock Washburn LLP

(57) ABSTRACT

A data storage cartridge has a stack of labels on one surface thereof. The labels are bound together by semi-tacky adhesive. The stack of repositionable, self-sticking, removable labels has a finger relief feature at one comer thereof. The cartridge has a relief cavity in one surface thereof to accommodate the stack of labels. A finger cavity in the surface of the cartridge provides access to the finger relief feature of the labels.

24 Claims, 1 Drawing Sheet

DATA STORAGE CARTRIDGE WITH MULTIPLE LABELS

FIELD OF THE INVENTION

This invention relates to removable storage cartridges and more particularly a cartridge having a stack of labels on one surface thereof.

BACKGROUND OF THE INVENTION

Data storage cartridges are used with magnetic disk drives, magnetic tape drives and optical storage drives. Examples include ZIP™ and JAZ™ cartridges both being available from Iomega Corporation.

Removable data storage cartridges such as ZIP™ (100 MB & 250 MB) and JAZ™ (1G & 2G), continue to get larger in capacity while the area of the user hand-writable label remains constant. This presents a problem for users wanting to maintain updated current disk content on the label. Typically the user changes the label contents every time a new project with data content is included with other data on the disk. At present the current label must be erased or removed and a new label adhered to the data storage cartridge.

Repositionable, self-sticking removable notes are available in stacks. "Post-It™" is a trademark of 3M Corporation for these self-stick removable notes. U.S. Pat. Nos. 3,691,140, 3,857,731, 4,166,152, 4,495,318, 5,045,569, Reissue 24,906 and 6,040,006, for example, relate to this type of notes.

It is an object of the present invention to make the labeling of data storage cartridges simpler, quicker, and more convenient for the user.

SUMMARY OF THE INVENTION

In accordance with the present invention a stack of self-stick removable labels adheres to one surface of a data storage cartridge. The labels are bound together by a semi-tacky adhesive. The stack of labels is placed in a relief cavity in one surface of the disk. One corner of each label is free of adhesive. A finger recess in the cartridge near the adhesive removed corner facilitates easy removal of the top label when the user desires access to label sub layers. Text on the label indicates what label layer the user has exposed.

In accordance with a further aspect of the invention the label stock is of vinyl material to facilitate a thin and durable label medium which is coated with a thin, pen or pencil printable, white overcoat with appropriate graphics and lined content writeable area.

The foregoing and other object, features and advantages will be better understood from the following more detailed description and appended claims.

SHORT DESCRIPTION OF THE DRAWINGS

DESCRIPTION OF THE PREFERRED EMBODIMENT

Figure 1:
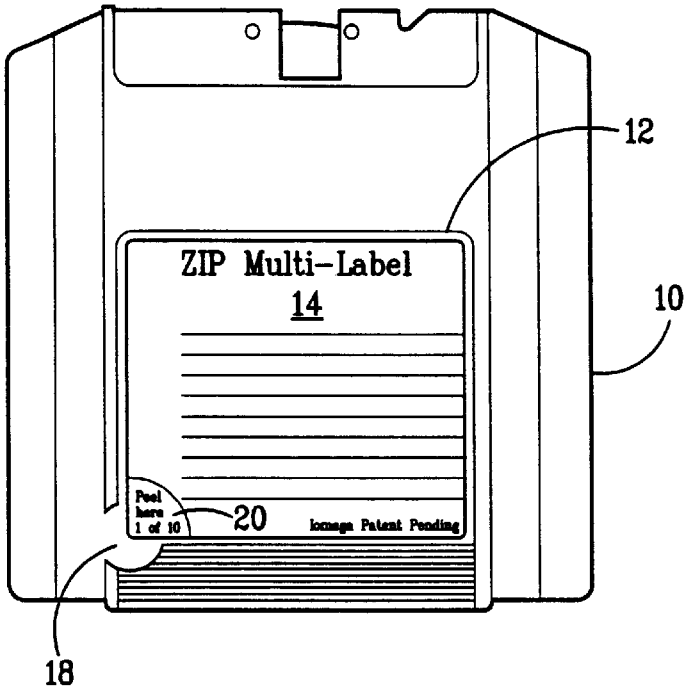
FIG. 1 shows a magnetic disk cartridge to which the labels of the present invention are affixed.

FIG. 1 depicts a ZIP™ cartridge 10 having a relief cavity 12 in one surface for placement of a stack of labels 14. A finger recess 18 in the cartridge is adjacent to a finger relief feature 20 on the label. This feature has no adhesive to facilitate removal of the top label. Text on the finger relief feature indicates what label layer the user has presently exposed. For example, "one often" is on the top label, "two often" is on the second label and so on. Except for the finger relief feature 20, the remainder of the surface of the label is coated with adhesive, that is important because otherwise the labels might curl and jam in the disk drive. The total stack of labels of the present invention is different from the Post-It™ notes in this respect.

Figure 3:
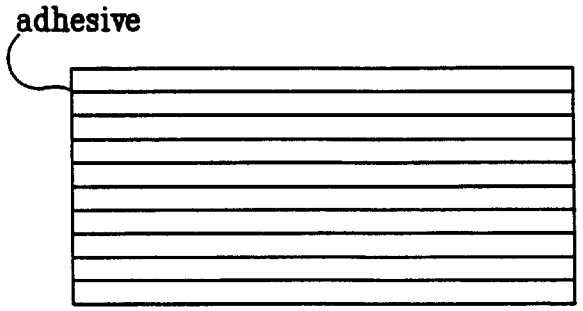
FIG. 3 is a cross-section of the stack of labels which is not to scale in thickness.

As shown in FIG. 3 the stack typically includes 10 labels. Label stock is 0.00.2 inch vinyl with a white pen writeable overcoat. The sheet tolerance in the plane of the label is +/−0.005 inches. The adhesive binding the stack together is 0.0005 inch thick. Post-It™ note type multi-use adhesive is described in the foregoing patents.

Data storage cartridges such as the ZIP™ and JAZ ™ cartridges have enough cartridge wall thickness to incorporate a 30 to 40 thousandths of an inch recess for inclusion of a thick label on the order of 0.025 inches thick. The standard paper label, with adhesive, which is used presently, is on the order of 0.004 inches thick. The ZIP™ cartridge, for example has a cartridge shell plastic-wall thickness of approximately 0.070 inches thick below the present label attachment area. This area is presently recessed about 0.010 inches from the highest surface on the front of the disk cartridge. Recessing of this label area's plastic another 0.030 inches still leaves 0.040 inches of cartridge wall. A 0.040 inch wall thickness is what is used typically in the construction of a 3.5 floppy cartridge wall. This local thickness will be sufficient for the ZIP™ application as well. This deep recess (>0.015 inch) in the cartridge wall for inclusion of the label is an important part of this invention.

The label is comprised of several (10) thin vinyl sheets (0.002 inches) of label stock adhered one on top of the other using "Post-It™" note type adhesive to bind the layers one on top of each other. "Post-It™" note adhesive means a semi-tacky adhesive that will bind the stack durably together during cartridge use, but allow for relatively easy removal of the top label by the user to gain access to the next un-marked label in the stack. This adhesive leaves essentially a tack free surface on the writeable portion of the label layer below it when removed. The adhesive on the removed label could then be used in a manner similar to a "Post-It™" note and adhered to some other surface such as the disk jewel case as a reminder of the other contents stored on the removable data storage media. A media contents book is thus generated for the user and readily accessible with the cartridge.

The selection of vinyl as the label stock facilitates a thin and durable label medium for the user. Thin organic pulp-based sheets may be used. The label stock is coated with a pen/pencil printable white over-coat. The surface has appropriate commercial graphics and lined content writeable area.

While a preferred embodiment has been shown and described, various modifications may be made. All such modifications within the true spirit and scope of the invention are covered by the appended claims.

What is claimed is:

1. A data storage cartridge comprising:

a stack of labels on a surface of said cartridge; and a semi-tacky adhesive binding said labels one to the other, said adhesive substantially covering one surface of each label wherein a portion of each label is free of adhesive.

2. The data storage cartridge cited in claim 1 wherein said labels are thin polymer sheets.

3. The cartridge cited in claim 2 wherein said polymer is vinyl.

4. The cartridge recited in claim 1 further comprising a relief cavity in the surface of said cartridge, said stack of labels being placed in said cavity.

5. The cartridge recited in claim 4 wherein said relief cavity is no greater than 0.015 inches deep.

6. The cartridge recited in claim 1 further comprising a finger relief feature on each label at one corner thereof, said feature being free of adhesive to facilitate removal of the top label in said stack.

7. The cartridge recited in claim 6 further comprising a finger cavity in a surface of said cartridge mating with said finger relief feature on each label to provide access to said feature.

8. The cartridge recited in claim 1 wherein said labels are thin organic pulp-based sheets.

9. The cartridge recited in claim 1 wherein said stack of labels is approximately 0.025 inches thick.

10. The cartridge recited in claim 1 wherein said stack of labels is no larger than 0.05 inches thick.

11. A data storage cartridge having a stack of repositionable, self-stick, removable labels thereon, said adhesive substantially covering one surface of each label wherein a portion of each label is free of adhesive.

12. The data storage cartridge cited in claim 11 wherein said labels are thin polymer sheets.

13. The cartridge cited in claim 12 wherein said polymer is vinyl.

14. The cartridge recited in claim 11 further comprising a relief cavity in the surface of said cartridge, said stack of labels being placed in said cavity.

15. The cartridge recited in claim 14 wherein said relief cavity is no greater than 0.015 inches deep.

16. The cartridge recited in claim 11 further comprising a finger relief feature on each label at one corner thereof, said feature being free of adhesive to facilitate removal of the top label in said stack.

17. The cartridge recited in claim 16 further comprising a finger cavity in a surface of said cartridge mating with said finger relief feature on each label to provide access to said feature.

18. The cartridge recited in claim 11 wherein said labels are thin organic pulp-based sheets.

19. The cartridge recited in claim 11 wherein said stack of labels is approximately 0.025 inches thick.

20. The cartridge recited in claim 11 wherein said stack of labels is no larger than 0.05 inches thick.

21. A data storage cartridge comprising:

a stack of labels on a surface of said cartridge;

a semi-tacky adhesive binding said labels one to the other; and a finger relief feature on each label at one corner thereof, said feature being free of adhesive to facilitate removal of the top label in said stack.

22. The cartridge recited in claim 21 further comprising:

a finger cavity in the surface of said cartridge mating with said finger relief feature on each label to provide access to said feature.

23. A data storage cartridge having a stack of repositionable, self-stick, removable labels thereon, and a finger relief feature on each label at one corner thereof, said feature being free of adhesive to facilitate removal of the top label in the said stack.

24. The cartridge recited in claim 23 further comprising a finger cavity in a surface of said cartridge mating with said finger relief finger on said label to provide access to said feature.

* * * * *

UNITED STATES PATENT AND TRADEMARK OFFICE

CERTIFICATE OF CORRECTION

Figure 2:
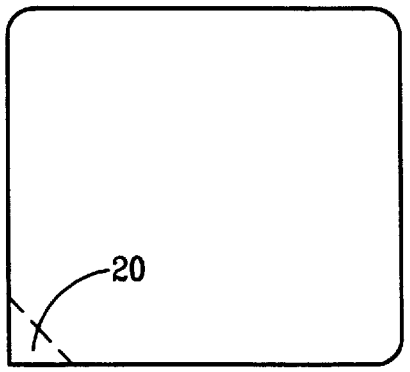
FIG. 2 is a view of the stack of labels depicting typical dimensions.

PATENT NO. : 6,360,466 B1
DATED : March 26, 2002
INVENTOR(S) : Fred C. Thomas, III It is certified that error appears in the above-identified patent and that said Letters Patent is hereby corrected as shown below:

Column 1,
Line 58, "Fig. 2 is a view of the stack of labels depicting typical dimensions" should be changed to -- Fig. 2 shows a plan view of the stack of labels depicting typical dimensions --.

Column 2,
Line 5, "one often" should be -- one of ten --.
Line 6, "often" should be -- of ten --.

Signed and Sealed this

Twenty-second Day of April, 2003

JAMES E. ROGAN
*Director of the United States Patent and Trademark Office*